United States Patent [19]

Bianchi

[11] 4,254,720

[45] Mar. 10, 1981

[54] ELECTROMECHANICAL ACTUATOR APPLIED TO AN ELECTRONICALLY CONTROLLED SEWING MACHINE

[75] Inventor: Nereo Bianchi, Pavia, Italy

[73] Assignee: Necchi Societa per Azioni, Pavia, Italy

[21] Appl. No.: 78,508

[22] Filed: Sep. 24, 1979

[30] Foreign Application Priority Data

Oct. 5, 1978 [IT] Italy ..... 42914 A/78

[51] Int. Cl.[3] ..... D05B 3/02

[52] U.S. Cl. ..... 112/158 E

[58] Field of Search ..... 112/158 E, 220, 121.12; 310/154, 13

[56] References Cited

U.S. PATENT DOCUMENTS

| | | | |
|---|---|---|---|
| 3,976,019 | 8/1976 | Allen et al. | 112/158 E |
| 4,016,441 | 4/1977 | Herr et al. | 310/13 |
| 4,143,606 | 3/1979 | Herr et al. | 112/158 E |

*Primary Examiner*—Peter P. Nerbun

*Attorney, Agent, or Firm*—Stevens, Davis, Miller & Mosher

[57] ABSTRACT

Electromechanical actuator applied to an electronically controlled sewing machine comprising a bed, a standard on the bed, an arm overhanging the bed, a head, a vertical pin fixed to the head, a needle bar gate transversely oscillatible around the vertical pin, a ferromagnetic frame formed by four walls each one opposite to another, a magnetic pole having the shape of a part of a circle ring connecting two of the opposite walls of the frame, and a conducting wire coil being slidably arranged on the magnetic pole to make circular oscillating paths when energized.

2 Claims, 3 Drawing Figures

ELECTROMECHANICAL ACTUATOR APPLIED TO AN ELECTRONICALLY CONTROLLED SEWING MACHINE

The present invention relates to an electromechanical actuator applied to an electronically controlled sewing machine comprising a bed, a standard, an arm overhanging the bed and a head carrying a needle bar gate mounted into the head in such a way as to make transverse oscillations around a vertical pin fixed to the head.

Electronically controlled sewing machines are already known on the market, wherein the needle bar transverse oscillations and the width and direction of the fabric feed member longitudinal displacements are controlled by electromechanical actuators fed with position analog signals derived by conversion from digital information stored in the sewing machine.

The actuators used in household type electronically controlled sewing machines must have small dimensions basically, and minimum inertia for their movable parts. Thanks to this last feature it is possible to obtain exactly and in the shortest time the subsequent positioning of stitch forming members relative to the fabric for the sequential execution of the single stitch forming a pattern.

An object of the present invention is to provide a new structure of known art actuators wherein the forces of inertia and outline dimensions are the smallest.

The object is obtained by making the actuators from a ferromagnetic frame formed by four walls each one opposite another and by a magnetic pole having the shape of a part of a circle ring connecting two of the opposite walls of the frame, a conducting wire coil being slidably arranged onto the magnetic pole to make circular oscillating paths.

A further object of the invention is to provide at one end of the conducting wire coil a U-shaped opening in which a suitable lug is directly engaged on the needle bar gate of the sewing machine. The needle bar and the sliding coil are thus strictly connected in their oscillations around the vertical pin.

Other details and features of the invention will stand out from the description given below by way of non-limitative example and with reference to the accompany drawings, in which.

Figure 1:
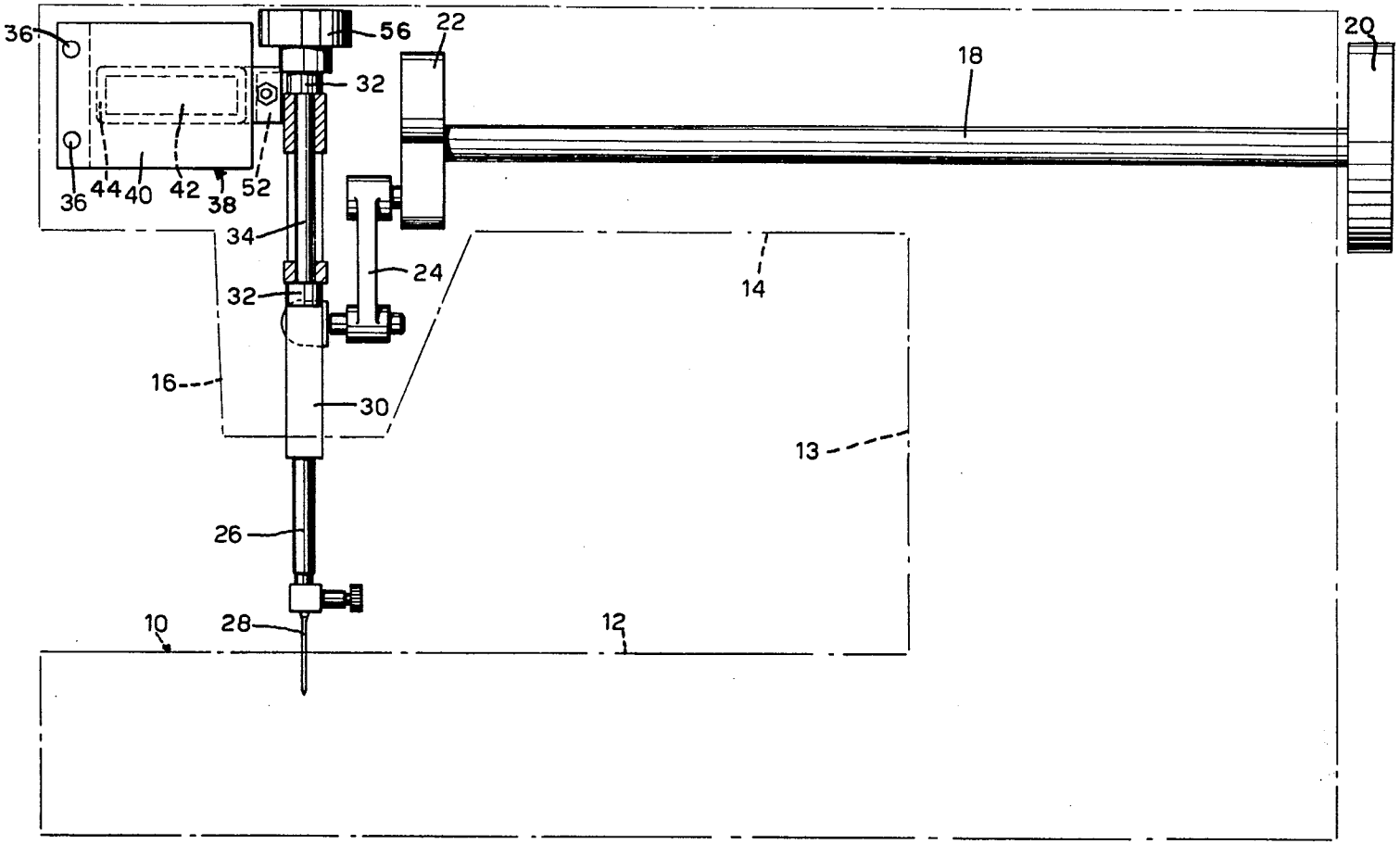
FIG. 1 shows schematically a sewing machine onto which is attached the present invention.

With reference to FIG. 1 there is shown by dotted line a frame 10 of a sewing machine comprising a bed 12, a standard 13, an arm 14 ending with a head 16.

Within arm 14 a shaft 18 is arranged to rotate. At one end of the shaft 18 handwheel 20 is fixed and at the opposite end a counterbalance 22 to which a connecting rod 24 is attached, in a known way. Connecting rod 24 imparts to the needle bar 26 and to needle 28 vertical oscillations necessary for the stitch formation.

Needle bar 26 also is arranged in such a way as to be able to make, besides vertical oscillations, transverse oscillations for obtaining zig-zag stitches and stitch patterns.

Figure 2:
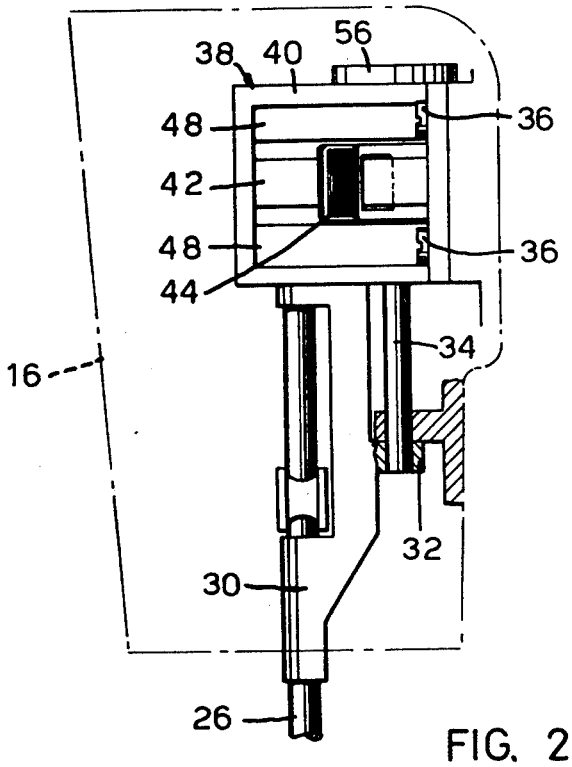
FIG. 2 shows a detailed view of the actuator of the invention.

In order to obtain this transverse oscillation needle bar 26 is mounted, free to make vertical displacements, onto a needle bar gate 30 (FIGS. 1 and 2), having lugs 32 provided with a guide hole suitable to engage a pin 34 fixed to head 16.

Thus needle bar gate 30 and needle bar 26 can rotate around the axis of pin 34.

Inside head 16 an electromechanical actuator 38 is fixed by means of screws 36 and is formed by a ferromagnetic frame 40 having four walls each one opposite to another.

Figure 3:
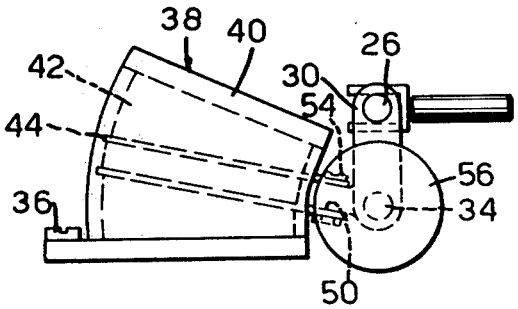
FIG. 3 shows a plan view of the structure of FIG. 2.

A magnetic pole 42 (FIGS. 2 and 3) is positioned inside the frame, connecting the two opposite vertical walls and upon which a copper wire coil 44 is slidably mounted. The magnetic pole 42 has the shape of a part of a circle ring and is placed between two permanent magnets 48 fixed inside the opposite horizontal walls of frame 40.

Coil 44 has at one end a U-shaped aperture 50 wherein lug 52 of needle bar gate 30 is fixed within the aperture 50 through a screw 54.

A potentiometer 56 is fixed by means of its control shaft to the upper portion of needle bar gate 30 to the axis of the shaft coinciding with the axis of pin 34.

An oscillation of coil 44 caused by a current flow in its wires, will cause needle bar gate 30 to oscillate and consequently the needle bar around the axis of pin 4, and at the same time, the potentiometer shaft to oscillate for the same angle. By this way a potentiometric current is estalished equal and opposite to the current which causes the bobbin and needle bar rotation according to the known closed servo-loop working.

It is a matter of course that a corresponding element providing pin 34 rotatable onto pins made out on said head, instead of fixed to head 16, and coil in mesh with the pin in its rotation does not go beyond the field of protection of the present invention.

What is claimed is:

1. Electromechanical actuator applied to an electronically controlled sewing machine, comprising a bed, a standard on said bed, an arm overhanging said bed, a head, a vertical pin fixed to said head, a needle bar gate transversely oscillatible around said vertical pin, a ferromagnetic frame formed by four walls each one opposite to another, a magnetic pole having the shape of a part of a circle ring connecting two of said opposite walls of said frame, and a conducting wire coil being slidably arranged on said magnetic pole to make circular oscillating paths when energized.

2. The electromechanical actuator according to claim 1, wherein said conducting wire coil is provided at one end with a U-shaped opening in which a lug on the needle bar gate of the sewing machine is directly engaged, said needle bar and said sliding coil being thus structurally connected in their oscillations around said vertical pin.

* * * * *